US005151555A

United States Patent [19]

Vatsvog

[11] Patent Number: 5,151,555

[45] Date of Patent: Sep. 29, 1992

[54] COMPOSITE CARTRIDGE FOR HIGH VELOCITY RIFLES AND THE LIKE

[76] Inventor: Marlo K. Vatsvog, 10708 Country Club La. S., Seattle, Wash. 98168

[21] Appl. No.: 706,310

[22] Filed: May 28, 1991

Related U.S. Application Data

[62] Division of Ser. No. 494,918, Mar. 12, 1990, Pat. No. 5,033,386.

[51] Int. Cl.[5] ..... F42B 3/00; F42B 5/02; F42B 33/00

[52] U.S. Cl. ..... 86/10; 86/23

[58] Field of Search ..... 86/10, 23, 25

[56] References Cited

U.S. PATENT DOCUMENTS 3,099,958 8/1963 Daubenspeck et al. ..... 102/42

3,369,443 2/1968 Shansey ..... 86/10

3,955,506 5/1976 Lather et al. ..... 102/43 P

*Primary Examiner*—J. W. Eldred

*Attorney, Agent, or Firm*—David L. Garrison

[57] ABSTRACT

A plastic cased metal headed ammunition casing for high powered rifle cartridges is described in which the plastic case has a pressure regulating baffle or wall in the forward end thereof to regulate and control the development of chamber pressure movement of the bullet into the rifle barrel. The cartridge is charged with a given charge of powder and the cap or head securely fastened to the rearward portion of the plastic casing. The head provides sufficient resistance to the residual pressure after firing so that the cartridge can be used in rapid fire automatic weapons.

15 Claims, 4 Drawing Sheets

COMPOSITE CARTRIDGE FOR HIGH VELOCITY RIFLES AND THE LIKE

This is a divisional of copending application(s) Ser. No. 07/494,918 filed on Mar. 12, 1990, now U.S. Pat. No. 5,033,386.

BACKGROUND OF THE INVENTION

This invention relates to improvements in the ammunition art, and specifically to improvements in the ammunition of the type used in high power rifles of all calibers in which an elastomer or plastic is used for a predominant portion of the casing which houses the powder and positions the projectile. The casing is made of a synthetic polymer composition attached to a metallic head positioned at the opposite end of the cartridge from the projectile.

Cartridges of this general type have been known in the literature for many years but have for one reason or another, failed to provide a satisfactory ammunition for sustained automatic fire in the modern automatic weapons widely used in police, paramilitary and military situations.

The following patents are known to disclose various types of composite cartridges of the general type to which this invention is addressed:

| | INVENTOR |
|---|---|
| U.S. PATENTS | |
| 2,654,319 | Roske |
| 2,826,446 | Ringdal |
| 3,026,802 | Barnet et al. |
| 3,099,958 | Daubenspeck, et al. |
| 3,745,924 | Scanlon |
| 3,842,739 | (unknown) |
| 3,874,294 | Hale |
| 3,977,326 | Anderson |
| 4,147,107 | Ringdal |
| UNITED KINGDOM | |
| 1,015,516 | Daubenspeck et al. |
| GB2,044,416 Application | Hebert |
| EUROPEAN PATENT APPLICATION | |
| 0 131 863 (Publn. 23.01.85) | Vatsvog |
| GERMAN PATENT | |
| 2,419,881 | |

Cartridges of this type are also used in large quantities as blank rifle cartridges in which the head end of the cartridge case continues into the imitation shape of a plastic projectile which constitutes an integral part of the cartridge case and has a notch or groove forming a predetermined rupture zone. These cartridges are loaded with a nominal amount of powder and are used as training and simulation aids without a projectile of the usual type. Because of the nominal loading of powder, cartridges of this type may not develop enough chamber pressure to operate the gas-operated automatic ejection and reloading mechanisms used in military type automatic weapons.

It is recognized that a plastic rifle cartridge should usually have a metal cap or head to carry the primer and to provide the ejection groove necessary to eject the spent cartridge from the firing chamber. When used in a modern automatic weapon the need is also present for a reinforced cap or head area to contain residual pressures in the cartridge occasionally encountered when the ejection cycle begins removal of the cartridge from the chamber before the pressure effects of the recent firing have fully dissipated. To achieve consistent performance, both ballistically and in the operation of the gas operated ejection mechanism, a rifle cartridge must develop a consistently high chamber pressure level for each round. Heretofore, the attainment of consistent pressure levels has been difficult, due to inconsistencies in the interfit between the bullet and the cartridge, improper sizing of the powder chamber for the powder used, and to the many variations in the performance in the burning cycle of the various powders available for use in rifle ammunition.

Conventional cartridges for rifles and machine guns, as well as larger caliber weapons are usually made with brass casings. The brass casing includes an integrally formed head containing a primer cup to receive a primer adapted to ignite a powder charge at one end, and at the other end provides a mechanical interfit to a bullet. The grip of the cartridge upon the bullet, together with the amount and characteristics of the powder, the interior volume of the powder chamber and other factors determine the chamber pressure levels developed during the firing cycle. The bullet or other projectile is held in place with a crimp or frictional engagement, the strength of which is a factor in determining the pressure needed to initiate bullet movement into the barrel of the rifle. Brass casings can be reloaded and thereby reused but suffer from several disadvantages, including weight. In addition, special tooling is necessary for reloading. Brass is also a relatively expensive metal which may be in short supply in some areas of the world, particularly in the event of war.

Expendable aluminum casings have been developed but generally are not reusable, making the ultimate cost of the aluminum casing comparable to brass. An extensive amount of precision metalworking equipment is necessary to form the casings from either brass or aluminum.

Several attempts have been made to develop a reusable handgun casing made of lightweight plastic materials, including my successful development described in my European patent application No. 0 131 863. In the use of plastic casings of the prior art, it is necessary that there be a tight fit between the casing and the bullet and between the casing and the head in order to prevent the escape of the gases formed when the powder charge is ignited. These gases in the handgun loads can quickly reach a pressure of over 10,000 psi, and thus the seal around the bullet and around the head must be tight enough to prevent the escape of the gases until the bullet is discharged. In rifle applications, such as the NATO 5.56 mm (.223 caliber) widely used in weapons such as the M-14 and M-15 used by the United States of America and its allies and various 5.56 mm rifles used by Warsaw pact forces pressures of 40,000 to 60,000 psi or higher may be encountered. The seal around the head is of extreme importance at these higher pressures as well as the strength of the head extending along a substantial distance of the side wall of the cartridge to prevent rupture of the sidewall of the cartridge during ejection of the spent cartridge. Such a rupture and escape of the gases would not only adversely effect the performance of the bullet being discharged but would also potentially adversely affect the subsequent firing of the rifle and could present a safety hazard to the rifleman or his companions.

Of great significance is the need to controllably maintain the chamber pressure developed by detonation or burning of the powder during the firing cycle so that a consistent pressure level is attained for a given powder load and type. In brass cased ammunition the pressure level is attained during and following burning of the powder in part through the crimp or frictional interfit between the bullet and the inner wall of the case. With plastic cases the control of the pressures has heretofore been erratic and unacceptable.

For military rounds, the need for reloading capability is minimized, so long as the round is relatively inexpensive to manufacture and load, and so long as the other desirable factors of the cartridge, such as corrosion resistance, weight, moisture resistance and the like provide a cartridge as dependable as brass.

Brass cartridges rely upon the crimp or frictional engagement with the bullet to control the buildup of pressure before bullet ejection. A more consistent and reliable control would provide more nearly consistent ballistics performance and is one of the attributes of this invention.

In all of the patents mentioned above the cartridge is formed of a composite plastic or metal and plastic casings which rely on multiple parts to provide the sealing around the end caps or head, and require a crimp about the bullet to hold the bullet in place. The cost of producing and assembling a multiple piece casing is high and heretofore the composite casings have not accomplished the dual functions of sealing the head to the plastic casing and the plastic casing to the bullet in a manner which permits the resulting cartridge to be used in fully automatic rifle firing applications.

DISCLOSURE OF THE INVENTION

It is an object of this invention to provide a lightweight plastic composite cartridge for use in high velocity rifle applications in which the pressure developed by ignition of the powder is controlled.

It is another object of the invention to provide a cartridge for rifle ammunition which can be used in fully automatic weapons.

Another object of this invention is to provide a cartridge which has a frangible pressure control bulkhead or partition which imparts pressure and force against the base of the bullet after a threshold level of pressure is attained to assure optimum powder ignition and complete burning.

A still further object of this invention is to provide ammunition in a cartridge in which the bullet can be inserted or removed easily without exposing the powder.

One further object of this invention is to provide a cartridge for rifle use which can have its powder load inserted from the base or head end of the cartridge without the presence of the bullet.

Another object of this invention is to provide a cartridge for use in a rifle which has a light frictional interfit with its bullet and no crimp or its equivalent to hold the bullet in place, for smooth and reproducible ejection of the bullet from the cartridge upon firing.

These and other objects of this invention are obtained by providing a tubular plastic casing made of a durable but elastic plastic material such as nylon which has the structural integrity to remain intact around the area upon which a malleable skirt is swaged to form the interconnection between the plastic casing and the head. The casing is formed by injection molding a relatively simple shape which may have draft angles built in to permit easy removal of the part from the male mold part. In the process of molding a partition or pressure control septum is molded in at the bullet-receiving end of the casing to define a bullet receiving recess and a powder receiving recess. A metal head is formed to slip on the end of the casing opposite the bullet receiving recess and be swaged into faired contact with the periphery of the casing in a sealed joint. Alternately, the head may be swaged prior to assembly and the elastomer casing forced into the head, the elastomer material being yieldable but possessing plastic memory sufficient to urge it toward its original shape and into firm contact with the interior surface of the head. The head has a primer recess into which a primer may be inserted coaxially with the head and casing. A primer flash hole or central vent extends coaxially into the powder chamber to ignite the powder upon detonation of the primer. The powder chamber is defined by the plastic casing, the pressure regulating frangible partition and by the head when it has been inserted axially over the casing and the skirt or a part thereof swaged into a fared interlock with the casing or into a circumferential groove. The volume of the powder chamber may be varied according to the type of powder being used so that the powder used fills the chamber to simplify loading and to optimize the burning characteristics of the powder. The pressure regulating front partition preferably is thickened from the frangible annular periphery thereof toward the cartridge axis in a semi-spherical configuration to provide application of forces evenly across the base of the bullet. The frangible partition functions to separate the powder chamber from the bullet receptacle, to seal the powder chamber at the forward end thereof and to provide a controlled pressure rupture threshold to controllably regulate the generation of pressure during the firing cycle so that the power of the powder is both maximized and controlled by regulating the pressure level at which the projectile begins to move. The strength cf the frangible annulus is tailored to the powder type and charge to provide the optimum powder burn cycle by increasing or decreasing the thickness during molding and by choice of the elastomer used.

DETAILED DESCRIPTION AND BEST MODE FOR CARRYING OUT THE INVENTION

Figure 1:
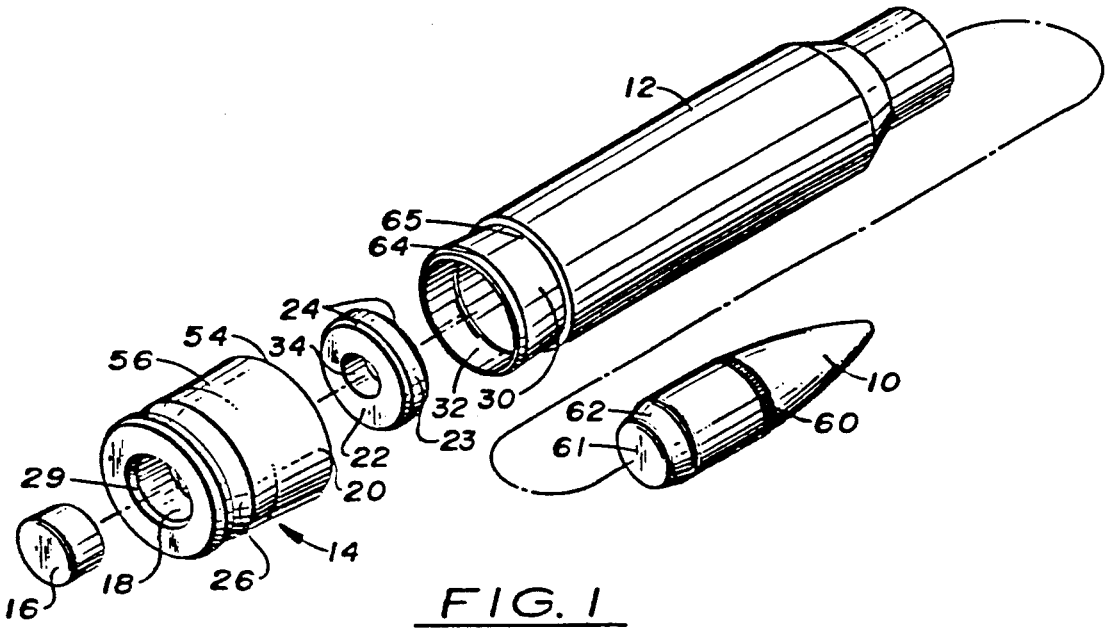
FIG. 1 shows an exploded perspective view of the composite cartridge of this invention for use with a boat tail bullet.

Referring particularly to the drawings where in like figures indicate like parts, there is seen in FIG. 1 an exploded view of one embodiment of this invention. A rifle cartridge suitable for use with high velocity rifles is shown manufactured with a polymer case 12 and a metallic head 14. A bullet 10 having a circumferential groove 60 is shown positioned for insertion into the forward end of plastic casing 12. A pressure regulating front partition 44 (best seen in FIGS. 2 through 6) securely closes off the forward portion of outer chamber 36 and is adapted to receive the base 61 of bullet 10. The forward portion of casing 12 has a thickened shoulder 42 forming chamber taper 40. The shoulder 42 supports a frangible annular zone 48 which is engineered and designed to be severed cleanly completely around the periphery of the shoulder 42 when sufficient pressure is developed on the interior of powder chamber 36. The pressure regulating front partition 44 has a semi cylindrical surface projecting rearwardly into the powder chamber 36 to aid in the even distribution of pressure to the bullet 10 upon detonation of the powder charge 38 contained in chamber 36. The frangible annulus 48 is sized in thickness to provide the desired level of pressure before bursting so that a controlled powder detonation can occur and further to provide the more nearly controllable pressure application to the base of bullet 10. The presence of the pressure regulating front partition 44 is made possible by the composite configuration of the cartridge. The front partition 44 is molded as a part of and extends inwardly from shoulder 42. The interior volume of powder chamber 36 may be varied to provide the volume necessary for complete filling of the chamber 36 by the powder chosen so that a simplified volumetric measure of powder can be utilized when loading the cartridge.

The end of plastic casing 12 opposite from the pressure regulating front partition 44 has means to engage and seal to a metallic head 14. Casing 12 is formed with a tapered skirt interlock surface 30 adapted to mate with and interlock with the deformable skirt 20 of head 14. The skirt interlock surface 30 preferably tapers from a larger diameter at the rearward most portion 64 thereof to a smaller diameter at the forward portion 65. A swaging anvil 22 may be used to provide backing for swaging of head 14 onto plastic casing 12. Anvil 22 is received within anvil recess 32 and provides support for the plastic casing 12 during the swaging process. Chamfers 24 are provided for ease of insertion of the anvil into the casing.

Head 14 is formed in a high pressure head forming apparatus as is well known in the prior art. However, the die used provides for a diverging deformable skirt 20 having a larger diameter at the skirt tip 54 and a relatively smaller diameter, approximating the outside diameter of head 14 at the skirt base 56. The thickness of skirt 20 increases from skirt base 56 to skirt tip 54 so that when swaged into contact with the tapered skirt interlock surface 30 a faired substantially cylindrical surface along the entire length of the assembled cartridge will result with a physical interlock between head 14 and plastic casing 12. Head 14 also has an extraction groove 26 cut therein and a primer recess 18 formed therein with primer chamfer 29 for ease of insertion of the primer 16. The primer recess 18 is sized so as to receive the primer 16 in an interference fit during assembly. A primer flash hole 28 communicates through the anvil central vent 34 into the powder chamber 36 so that upon detonation of primer 16 the powder in powder chamber 36 will be ignited. An alternative structure would include a groove at portion 65 to receive a swaged tip section 54 in a head configuration without the flared skirt configuration described above.

Bullet 10 is held in place within bullet recess 50 by a frictional interfit. The bullet may be inserted into place following the completion of the filling of powder chamber 36 and final assembly of the cartridge by swaging the deformable skirt 20 into contact with the tapered skirt interlock surface 30. In this way bullets of differing size and characteristics can be utilized and may even be interchanged without affecting or exposing the powder in powder chamber 36.

Figure 3:
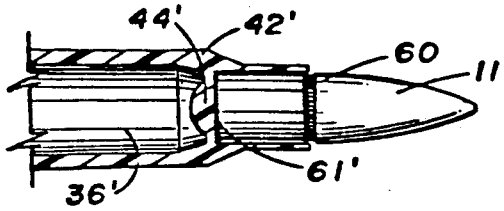
FIG. 3 is a partial cross sectional view of a second embodiment of the cartridge of this invention for use with a flat base bullet.

Whenever a flat bottom bullet is used the configuration shown in FIG. 3 may be used to accommodate the particular bullet shape desired. In this embodiment the shoulder 42' is formed with a smaller interior angle from the axis to accommodate the full diameter of bullet 11'. The flat base 61' rests against the pressure regulating front partition 44' which is configured with a larger diameter so that the entire base 61' receives the pressure developed within chamber 36'.

Figure 4:
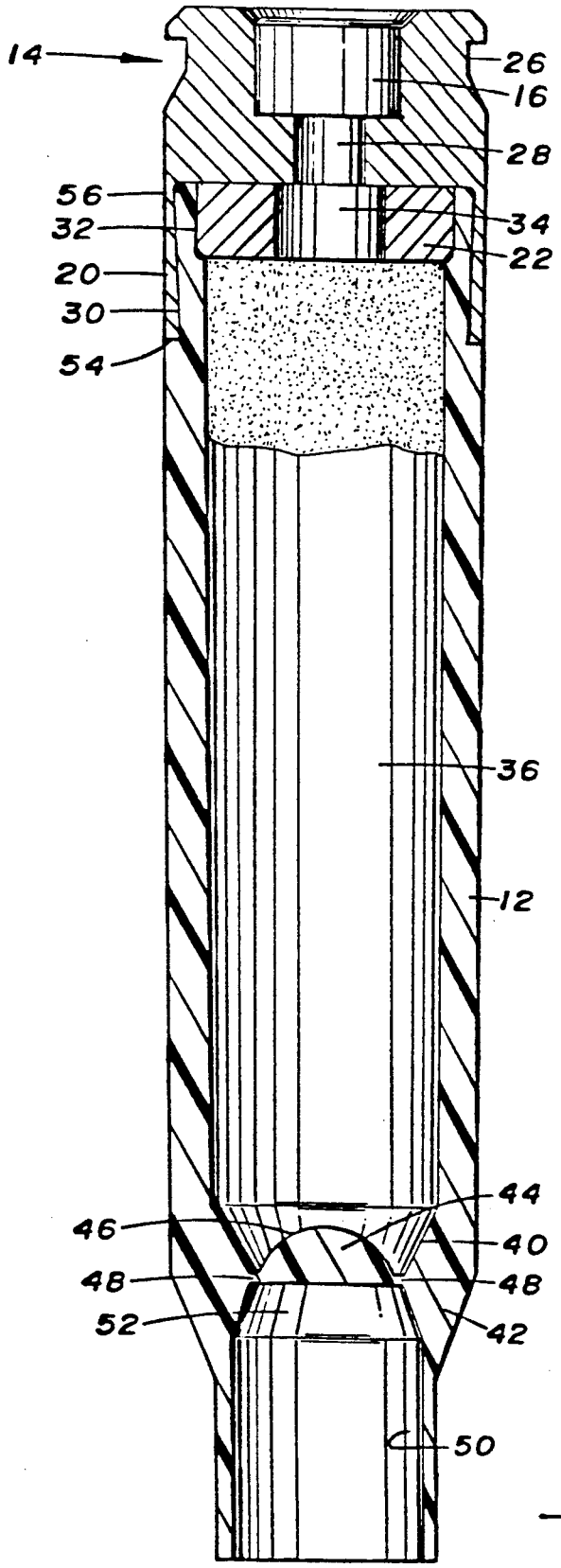
FIG. 4 is an enlarged axial cross sectional view of the cartridge shown in FIG. 1.
Figure 5:
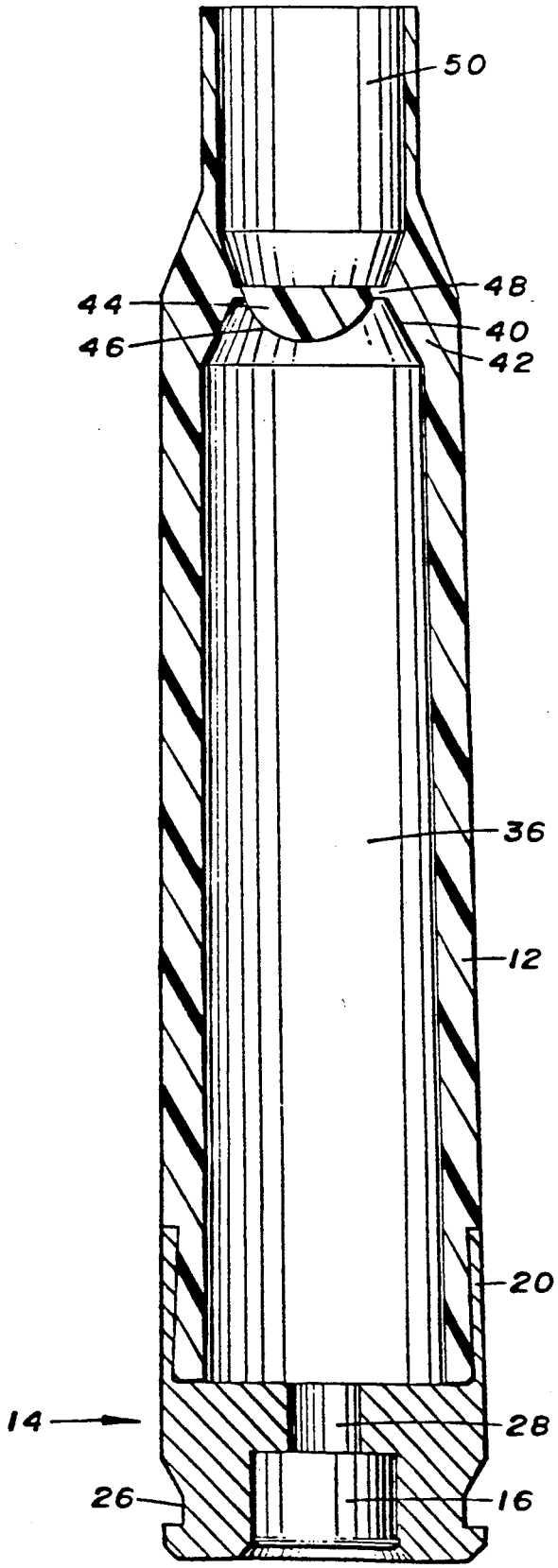
FIG. 5 is an enlarged axial cross sectional view of another embodiment of this invention.

When it is desired to have a larger volume in powder chamber 36, the configurations shown in FIGS. 5 and 6 through 9 may be utilized. In FIG. 5 the anvil (shown as 22 in FIG. 4) is omitted with the deformable skirt 20 being swaged carefully against the surface of casing 12. Omitting the anvil permits a larger charge of powder to be placed into the casing. The thickness of the plastic casing 12 and shoulder 42 can also be varied so that the volume of powder chamber 36 can be modified for various powder types and loads to provide a consistent performance with any given powder.

Figure 6:
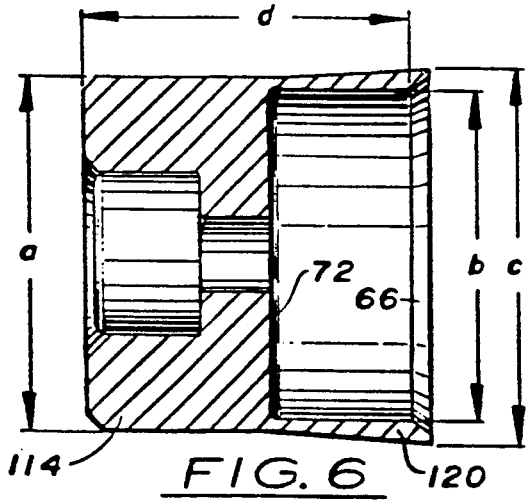
FIG. 6 is a cross sectional view of the partially manufactured metallic head useful in one embodiment of this invention.
Figure 7:
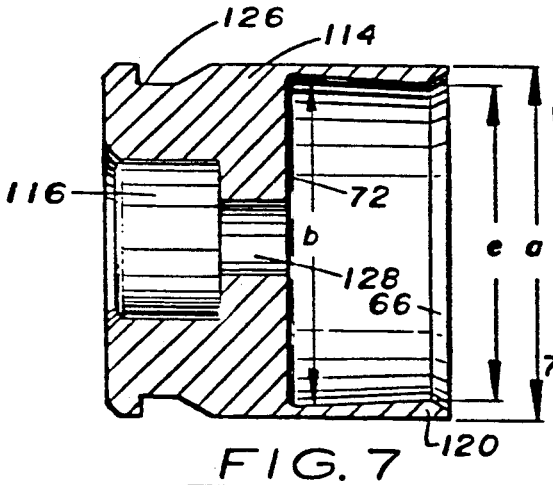
FIG. 7 is a cross sectional view of the device shown in FIG. 6 after a extraction groove cutting and forming step.

Another alternative embodiment is shown in FIGS. 6 through 9 in which the head 114 is formed and the deformable skirt thereof swaged prior to assembly with the plastic casing 112. As seen in FIG. 6, the head 114 is formed by known head forming techniques into the shape as shown with the deformable skirt 120 having a substantially cylindrical interior and a diverging exterior surface as shown. The interior diameter b is formed so that the device may be removed from the die and the exterior surface diverges outwardly to the diameter c. Annular extractor groove 126 is then cut into the formed head and the deformable skirt is swaged into the condition shown in FIG. 7 with the base of the recess to receive the plastic casing having an interior diameter b and the throat of the recess to receive the casing having an interior diameter e. A chamfer 66 is provided to guide and press inwardly the end of the plastic cartridge 112 as is further described below. A primer recess 116 and flash hole 128 are also formed in head 114 at the time it is formed.

Figure 8:
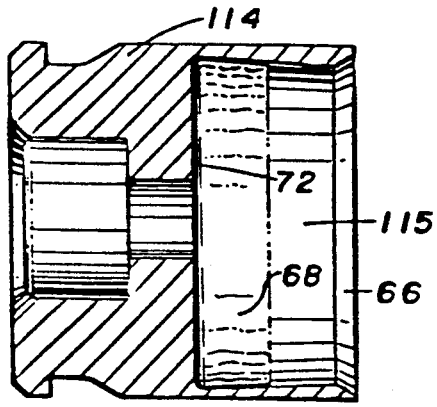
FIG. 8 is a cross sectional view of the device shown in FIG. 7 with an adhesive material applied to the interior surface thereof.
Figure 9:
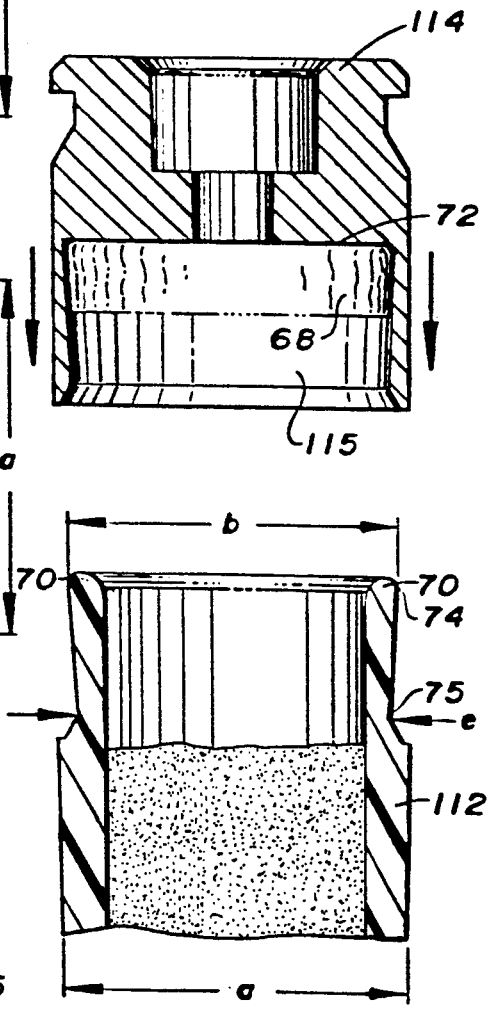
FIG. 9 shows a cross sectional representation of the final assembly step to unite the plastic casing to the metallic head in one embodiment of this invention.

In FIG. 8 an adhesive 68 is shown spread on the interior surface of the casing recess 115. The adhesive 68 is preferably a contact type cement compatible with the metal forming head 114 and the plastic material forming plastic casing 112. FIG. 9 shows the assembly step following completion of the head and filling of the powder chamber 136 with powder. Head 114 is positioned coaxially with the filled plastic casing 112 and the elements are moved axially together, forcing the rounded end 70 of plastic casing 112 into recess 115 until the rounded ends 70 abut upon the base 72 of recess 115. When assembled the elastic memory of casing 112 will cause the end 70 of casing 112 to expand and contact the interior of recess 115 in a tight interference fit. The diameter of rounded end 70 at portion 74 is shown in FIG. 9 as being equivalent to the interior diameter of recess 115 at the base thereof and larger than the diameter of portion 75. As a result the plastic casing firmly contacts the adhesive 68 forming a secure mechanical and water tight bond to hold the elements of the completed cartridge together. In each embodiment set forth above, the deformable skirt 20 or 120 extends far enough up the side of the casing to provide casing strength preventing blow out of the side of the casing during rapid automatic fire. The adhesive is optional and may be omitted under circumstances in which the interfit between head and plastic casing is found to be adequate without the adhesive being used.

The experienced handloader or ammunition manufacturer will know that many powder types and weights can be used to prepare workable ammunition and that such loads may be determined by a careful trial including initial low quantity loading of a given powder and the well known stepwise increasing of a given powder loading until a maximum acceptable load is achieved. Extreme care and caution is advised in evaluating new loads. The powders available have various burn rates and must be carefully chosen so that a safe load is devised. The following examples show some of the stepwise progression of loads undertaken by the inventor to establish the acceptable chamber pressures, bullet velocities and performance at this inventor's present stage of development which reflect workable and usable ammunition.

EXAMPLE 1

A cartridge of the type shown in FIG. 4 for use with the 5.56 ml. NATO (.223 caliber) high velocity rifle was prepared as follows: A 55 grain boat tail full metal jacket bullet was used of the type shown in FIG. 1. The plastic casing 12 was formed from an unpigmented Dupont 901 super tough ST nylon available from E. I. Dupont, Wilmington, Delaware. The pressure regulating front partition 44 was formed using a frangible annulus 48 having a thickness of 0.020 inches. 21.4 grains of Hodgedon H-335 spherical powder, having a moderate burn rate, was used. A CCI small rifle magnum primer manufactured by CCI Industries was inserted into the primer recess. The round was fired through a 5.56 mm (.223 caliber) pressure barrel with 1 in 7 twist manufactured by Obermeyer Rifled Barrels attached to a universal receiver to determine the pressure developed in the chamber when fired. A pressure of about 45,000 psi was measured using the standard copper crush test.

EXAMPLE 2

A cartridge identical to that described in Example 1 was prepared using 18.7 grains of Hodgedon H-335 with a pressure regulating front partition 44 having a frangible annulus with a thickness of 0.010 inches. A chamber pressure of 30,000 psi was observed upon firing.

EXAMPLE 3

Cartridges loaded in accordance with example 1 were fired in a semiautomatic rapid fire mode in a .223 caliber semi automatic rifle to evaluate the ejection of spent cartridges and performance. Thirty rounds were loaded into a clip and fired as rapidly as possible in the semi automatic mode. All 30 rounds were fired and were ejected successfully from the automatic ejection mechanism.

EXAMPLE 4

Figure 2:
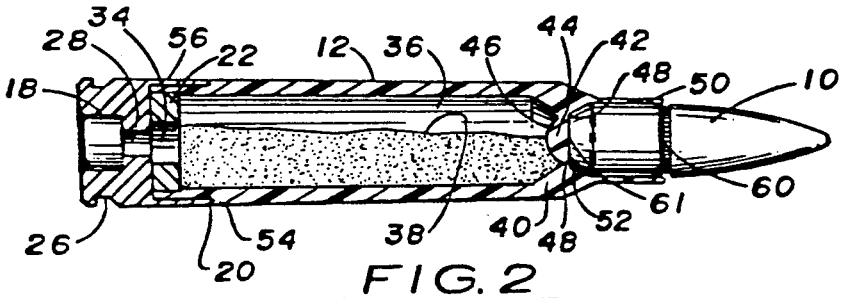
FIG. 2 shows one embodiment of this invention with the casing and head in cross section.

Ten cartridges constructed as shown in FIGS. 1, 2 and 4 was constructed using a head 14 made of 1010 steel alloy. A CCI small rifle magnum primer was placed into the primer recess and 21.4 grains of BL-C-(2) powder which is a rapid burning powder was placed into the powder chamber 36. The swaging anvil 22 was placed into the open end of the powder chamber 36, and the head 14 was carefully swaged about the exterior of the plastic casing 12. The outer surface of the cartridge was smooth and faired at the intersection of the metal cap and the plastic case. A 55 grain full metal jacket spire point boat tail bullet was inserted into the bullet recess. The plastic casing had a pressure regulating front partition having a frangible annulus with a thickness of 0.020 inches. The round was fired in a universal receiver with the .223 caliber barrel manufactured by Obermeyer attached thereto. When discharged the rounds developed chamber pressures in the range of 38,000 to 40,000 psi and were grouped in a 2 inch diameter circle upon a target set at 50 yards.

EXAMPLE 5

Several rounds identical to those described in Example 4 were prepared using 21.4 grains of Hodgedon H-335 powder. When fired the rounds developed a cylinder pressure of 43,000 to 45,000 psi.

EXAMPLE 6

A round identical to those described in Example 4 was prepared but using a front pressure regulating partition having a frangible annulus thickness of 0.010 inches. 21.4 grains of BL-C-(2) powder developed 33,000 psi chamber pressure when discharged.

EXAMPLE 7

A round identical to the round described in Example 6 was prepared but with a front pressure regulating partition having a frangible annulus of 0.020 inches thickness. Upon discharge the round developed 43,000 psi chamber pressure.

EXAMPLE 8

A round identical to the round described in Example 6 was prepared using 21.4 grains of Hodgedon H-335 powder. When discharged the round developed 33,000 psi chamber pressure.

EXAMPLE 9

A round was constructed using the procedure and structures shown in FIGS. 6–9. Low nitrogen content series 1010 steel was fed into a heading machine to form the head precursor form shown in FIG. 6. The dimensions shown were as follows:

a=0.376 inches
b=0.355 inches
c=0.398 inches
d=0.375 inches
e=0.334 inches

Bevel 66 was formed at about 30 degrees from the axis of the head 114. The ejection grove 126 was then cut into head 114 and the skirt 120 swaged inwardly so that the outer surface of the head 114 was cylindrical along its entire length. An adhesive material, sold under the trade designation PRONTO-LINE CA-9, a product of 3M Corporation, Minneapolis Minn., was sprayed upon the interior of head 113 to form a band of adhesive 68. The adhesive was permitted to dry for 15 minutes. 21.4 grains of Hodgedon H-335 powder was placed into a vertically oriented plastic casing having a pressure regulating front partition with a frangible annulus thickness of 0.020 inches. The head 114 was positioned above the plastic casing as shown in FIG. 9 and quickly and firmly thrust over the rounded upper end of casing 112, firmly seating the cap fully upon casing 112. Since the diameter b of the upper end of casing 112 exceeds the inside diameter e of head 114, the casing end was slightly deformed inwardly toward the axis and upon full engagement of the parts as returned to its former configuration due to the plastic memory of the casing material. The adhesive material then engaged the plastic surface to form a structural and water tight bond A 55 grain spire point boat tail full metal jacket bullet was then inserted into the bullet recess and the cartridge fired in the universal receiver having a 20 inch .223 caliber barrel noted above. The round developed 44,000 psi chamber pressure and the bullet hit its intended target at 50 yards.

EXAMPLE 10

A test firing of twenty five cartridges manufactured and loaded as set forth in Example 4 with 18.0 grains of IMR 4198 powder with a comparison to factory ammunition was conducted by H. P. White Laboratory, Inc., 3114 Scarboro Road, Street, Md., 21154. The ammunition tested was hand loaded by the inventor and was designated as 5.56 mm Plastic case with a 55 grain Sierra FMJBT bullet. The rounds were compared to 10 rounds of a conventional brass cased ammunition prepared and sold by Olin Corp., Winchester Division in 5.56 mm with a 55 grain FMJ bullet. All rounds tested were fired in a NATO pressure barrel, H. P. White Ser. No. 10, having a barrel length of 20 inches. The velocity and chamber pressure results are set forth below:

| PLASTIC CASE WITH PRESSURE REGULATING PARTITION | | |
|---|---|---|
| ROUND NO. | VELOCITY fps | PRESSURE psi |
| 1 | 2812.1 | 51,800 |
| 2 | 2907.8 | 58,400 |
| 3 | 2914.1 | 58,800 |
| 4 | 2896.4 | 57,200 |
| 5 | 2923.1 | 55,600 |
| 6 | 2953.7 | 58,000 |
| 7 | 2946.8 | 61,300 |
| 8 | 2908.2 | 58,000 |
| 9 | 2960.7 | 64,100 |
| 10 | 2954.2 | 64,400 |
| 11 | 2857.9 | 54,000 |
| 12 | 2966.9 | 64,100 |
| 13 | 2942.4 | 59,600 |
| 14 | 2947.2 | 61,600 |
| 15 | 2998.5 | 66,900 |
| 16 | 2988.6 | 64,100 |
| 17 | 2942.0 | 60,600 |
| 18 | 2940.3 | 62,500 |
| 19 | 2933.8 | 59,600 |
| 20 | 2967.3 | 61,900 |
| 21 | 2911.6 | 60,300 |
| 22 | 2912.0 | 58,800 |
| 23 | 2970.0 | 61,900 |
| 24 | 2896.0 | 58,400 |
| 25 | 2974.4 | 61,300 |
| Average | 2933.0 | 60,100 |

-continued

| PLASTIC CASE WITH PRESSURE REGULATING PARTITION | | |
|---|---|---|
| ROUND NO. | VELOCITY fps | PRESSURE psi |
| Std. Dev. | 40.3 | 3,368 |

| FACTORY LOADS | | |
|---|---|---|
| ROUND NO. | VELOCITY fps | PRESSURE psi |
| 1 | 3159.0 | 49,900 |
| 2 | 3194.8 | 48,000 |
| 3 | 3160.5 | 47,600 |
| 4 | 3171.5 | 45,900 |
| 5 | 3153.5 | 45,400 |
| 6 | 3162.5 | 45,900 |
| 7 | 3136.2 | 45,000 |
| 8 | 3187.2 | 47,600 |
| 9 | 3190.3 | 47,100 |
| 10 | 3200.5 | 47,100 |
| Average | 3171.6 | 47,000 |
| Std. Dev. | 19.78 | 1,382 |

In compliance with the statutory requirements, the invention in various embodiments has been described in language more or less specific as to structural features and methods to enable one of skill in this art to practice the invention. It is to be understood, however, that the invention is not limited to the specific features and methods shown and described, since the means and constructions herein disclosed comprise a preferred form of putting the invention into effect. The invention is, therefore claimed in any of its forms or embodiments within the legitimate and valid scope of the appended claims, appropriately interpreted in accordance with the doctrine of equivalence.

I claim:

1. A method of manufacturing a rifle cartridge comprising the steps of:

molding a substantially cylindrical plastic cartridge having a bullet receiving end forming a bullet recess; an open, head receiving end with a circumferential head interlock surface thereon; a casing axially disposed between said ends with a thickened shoulder formed therein,; and a pressure regulating front partition extending across the casing separating the bullet recess from a powder chamber at said thickened shoulder, said partition having a frangible annular zone designed to be severed cleanly completely around the periphery thereof;

forming a cartridge head having a coaxial primer recess and a coaxial casing receiving recess, said casing receiving recess comprising a deformable skirt adapted to be swaged into contact about said circumferential head interlock surface;

placing a charge of gunpowder in said casing;

placing a primer in said primer recess;

assembling said casing and said head; and, swaging said deformable skirt about said head interlock surface to firmly interconnect said casing and said head.

2. The process of claim 1 and inserting a bullet into said bullet recess.

3. The method of claim 1 and interlocking said head and said casing to prevent relative rotation.

4. The method of claim 3 wherein said head and said casing are interlocked mechanically.

5. The method of claim 3 wherein said head and said casing are adhesively bonded together.

6. The method of claim 3 and sizing said casing to receive a predetermined volume of powder.

7. The method of claim 1 and sizing said pressure regulating front partition to sever at a predetermined chamber pressure.

8. A method of manufacturing ammunition comprising the steps of:

molding a substantially cylindrical plastic cartridge having a bullet receiving end forming a bullet recess, an open, head receiving end with a circumferential head interlock surface thereon, a casing axially disposed between said ends having a thickener shoulder therein adjacent said bullet receiving end; and a pressure regulating front partition extending across the casing at said thickened shoulder separating the bullet recess from a powder chamber;

forming a cartridge head having a coaxial primer recess and a coaxial casing receiving recess having an inside diameter approximately equal to the outside diameter of said casing;

placing a charge of gunpowder into said casing;

placing a primer in said primer recess;

forcing said head and said casing together axially whereby said head receiving end is inserted within said head.

9. The method of claim 8 wherein said head receiving end is initially compressed inwardly during said assembly step and then returns to its original shape to firmly contact the interior surface of said head.

10. The method of claim 8 wherein a coating of adhesive material is applied to the interior of said head before assembly.

11. The method of claim 8 wherein said pressure regulating front partition has a thickness of from 0.010 to 0.020 inches.

12. The method of claim 8 wherein said charge of gun powder and said pressure regulating front partition are chosen so that the chamber pressure of 40,000 to 60,000 psi occurs upon firing of said cartridge in a rifle chamber.

13. The method of claim 8 wherein said cartridge head is formed with a flared deformable skirt and the further step of swaging said skirt into tight contact with said head interlock surface.

14. The method of claim 8 wherein said cartridge head is formed with a deformable skirt and the further step of swaging said skirt into a substantially cylindrical configuration prior to assembly with said casing.

15. The method of claim 8 wherein said casing receiving recess is tapered.

* * * * *